US006394106B1

(12) United States Patent
Jolley

(10) Patent No.: US 6,394,106 B1
(45) Date of Patent: May 28, 2002

(54) CLEANING SOLUTIONS AND METHODS FOR SEMICONDUCTOR WAFERS

(76) Inventor: Michael Jolley, 655 W. Reserve Dr., Kalispell, MT (US) 59901

( * ) Notice: Subject to any disclaimer, the term of this patent is extended or adjusted under 35 U.S.C. 154(b) by 0 days.

(21) Appl. No.: 09/649,228

(22) Filed: Aug. 28, 2000

Related U.S. Application Data

(62) Division of application No. 09/406,094, filed on Sep. 24, 1999, now abandoned.

(51) Int. Cl.[7] ..... B08B 3/04; B08B 3/08; C11D 1/83; C11D 3/04

(52) U.S. Cl. ..... 134/1.3; 134/39; 510/175; 510/176

(58) Field of Search ..... 510/175, 176; 134/1.3, 39

(56) References Cited

U.S. PATENT DOCUMENTS

| | | | | |
|---|---|---|---|---|
| 4,156,619 A | | 5/1979 | Griesshammer | |
| RE32,661 E | | 5/1988 | Binns | |
| 5,382,296 A | | 1/1995 | Anttila | |
| 5,443,747 A | * | 8/1995 | Inada et al. | 252/94 |
| 5,509,970 A | | 4/1996 | Shiramizu | |
| 5,626,681 A | | 5/1997 | Nakano et al. | |
| 5,656,097 A | | 8/1997 | Olesen et al. | |
| 5,954,891 A | * | 9/1999 | Kondoh et al. | 134/40 |
| 5,962,385 A | * | 10/1999 | Maruyama et al. | 510/176 |
| 5,985,811 A | * | 11/1999 | Masayuki et al. | 510/175 |

* cited by examiner

*Primary Examiner*—Gregory DelCotto

(57) ABSTRACT

A mixture for cleaning slurries left on the surface of a semiconductor wafer, after a polishing step, includes a caustic, an anionic surfactant, a non-ionic surfactant, and water. The caustic provides an etch rate on the surface to be cleaned in the range of 1–100 Angstroms per minute. The ionic concentration of the caustic ranges from 0.5N to 0.000001N. The caustic etches the surface. The anionic surfactant prevents particle redeposition. The non-ionic surfactant inhibits pitting of the backside of the wafers, if they have exposed silicon or polysilicon.

6 Claims, No Drawings

CLEANING SOLUTIONS AND METHODS FOR SEMICONDUCTOR WAFERS

This application is a divisional of Ser. No. 09/406,094, filed Sep. 24, 1999, which is now abandoned.

BACKGROUND OF THE INVENTION

Manufacturing semiconductor wafers or similar articles such as flat panel displays, hard disk media, CD glass, etc., requires chemical-mechanical polishing steps at various points in the processing sequence. Abrasives based on either alumina or silica, along with chemical additives, are typically used in these polishing steps. After the polishing is done, a cleaning step is needed to remove the slurries left by the polishing step. The slurries have typically been removed with brush cleaning. While brush cleaning has been successfully used, it has certain disadvantages, e.g., in cost and speed, primarily resulting from the need for mechanical movement between the brush and the wafer surface. While a purely chemical cleaning process can avoid the disadvantages of brush cleaning, difficulties have remained in developing a chemical cleaning process which is effective in removing the slurry, while at the same time not contaminating or degrading the wafer or work piece.

SUMMARY OF THE INVENTION

A new chemical mixture has now been developed which effectively removes the slurries, without mechanically brushing or scrubbing, and without degrading the work piece.

In a first aspect of the invention, the cleaning mixture includes a caustic, an anionic surfactant, a non-ionic surfactant, and water. The caustic preferably has an ionic concentration in the range of 0.5 to 10.00000N, and more preferably an ionic concentration in the range of 0.10 to 0.01N. The ionic concentration of the caustic advantageously provides an etch rate on the surface of from 1 to 100 Angstroms per minute.

In a method for cleaning slurries from a semiconductor article surface, the article is first rinsed with deionized water. The article is then preheated with hot deionized water. The chemical cleaning mixture is applied to the article surface. The surface is then rinsed and dried.

DETAILED DESCRIPTION OF THE INVENTION

The present caustic cleaning solution has four parts.

The first and major component is water.

The second component is a caustic such as tetramethylammoniumhydroxide (TMAH), a caustic widely used in the semiconductor industry. However, sodium hydroxide (NaOH), potassium hydroxide (KOH), and ammonium hydroxide, as well as other caustics, may be used. The caustic is selected to provide an etch rate on the surface to be cleaned in the range of from 1–100 Angstroms per minute. The caustic has an ionic concentration in the range of 0.5 to 0.000001N, with a more preferred concentration in the range of 0.2–0.01N.

The third component of the mixture is an anionic surfactant, preferably FC93, available from 3M Corporation, Minneapolis, Minn. FC93 is a surfactant widely used in the semiconductor industry. The anionic surfactant coats the surfaces of the article or silicon wafer and loose particles, with a negative charge, and prevents particle re-deposition after particles are lifted off of the surface during the caustic etch.

The fourth component of the mixture is a non-ionic surfactant, preferably Waco Chemical Company (Japan), NCW 601 A. The non-ionic surfactant inhibits pitting of the backsides of the wafers or articles, if they have exposed silicon or polysilicon on them. Pitting, if not prevented, can cause particle transmission from the backside of one wafer to the front side of the wafer behind it.

Each of the surfactants (the anionic and the non-ionic) are provided in the mixture with volume fractions of 1 cc of each, for every 10,0000–20,000 cc of solution, and preferably 1 cc of each for every 15,000 cc of solution. The volumetric ratio of the nonionic and anionic surfactants to water ranges from 0.5/3000 to 1.5/3000. The caustic is provided into the mixture or solution with a volume or concentration to make the desired normal range. Water makes up the balance of the solution, typically 85–95%, and most often near 90% by volume.

In use, the wafer or article to be cleaned is pre-rinsed with cold (room temperature) deionized water. The article surface is then heated with hot, deionized water. The cleaning mixture described above is then applied to the surface. The cleaning mixture is left in place on the surface for a time interval sufficient to allow the caustic to remove the slurry. The surface is then rinsed with deionized water, and then dried.

The deionized water, in the steps described above, can be applied to the surface by spraying, or by immersing the surface into a bath. Similarly, the chemical cleaning mixture can also be sprayed onto the surface, or the surface can be immersed into a bath of the cleaning mixture. The steps described above may be performed in existing semiconductor processing equipment, in a batch mode, or with single wafers or articles.

Thus, a novel cleaning solution and method have been described. Various modifications and substitutions can of course be made without departing from the spirit and scope of the invention. The invention, therefore, should not be limited, except by the following claims, and their equivalents

What is claimed is:

1. A method for removing slurry from a surface of a semiconductor article, comprising the steps of:

rinsing the surface with deionized water;

preheating the surface by applying hot deionized water to the surface;

cleaning the surface by exposing the surface to a mixture of a caustic selected from the group consisting of sodium hydroxide, potassium hydroxide, ammonium hydroxide, and tetramethyl hydroxide, an anionic surfactant, a non-ionic surfactant, and water wherein the volumetric ratio of the nonionic and the anionic surfactants to water ranges from 0.5/3000 to 1.5/3000, and the concentration of caustic is from 0.01 to 10.00000N;

rinsing the surface with deionized water; and drying the surface.

2. The method of claim 1 where the caustic has a concentration of from 0.01 to 0.10N.

3. The method of claim 1 where the surface is immersed in the mixture.

4. The method of claim 1 with the caustic etching the surface at a rate of from 1 to 100 Angstroms/minute.

5. The method of claim 1 with the water making up fro 85 to 95% of the mixture by volume.

6. The method of claim 1 where the caustic has a concentration of from 0.01 to 0.20N.

* * * * *